US005353462A

United States Patent [19]

Ueno et al.

[11] Patent Number: 5,353,462

[45] Date of Patent: Oct. 11, 1994

[54] GLASS PLATE WASHING MACHINE

[75] Inventors: Yasushi Ueno, Matsusaka; Masato Nakamura, Obata, both of Japan

[73] Assignee: Central Glass Co., Ltd., Yamaguchi, Japan

[21] Appl. No.: 63,031

[22] Filed: May 18, 1993

[30] Foreign Application Priority Data

May 18, 1992 [JP] Japan ..... 4-032555[U]

[51] Int. Cl.[5] ..... B08B 11/04

[52] U.S. Cl. ..... 15/102; 15/97.1; 15/77; 451/111

[58] Field of Search ..... 15/103, 102, 77, 97.1; 51/283 R, 284 R

[56] References Cited

FOREIGN PATENT DOCUMENTS 1059172 6/1959 Fed. Rep. of Germany .
2452700 5/1975 Fed. Rep. of Germany .
2548561 1/1985 France .
38-5017 4/1963 Japan ..... 15/77
63-27249 2/1988 Japan .
21290 1/1990 Japan .

*Primary Examiner*—Edward L. Roberts
*Attorney, Agent, or Firm*—Cushman, Darby & Cushman

[57] ABSTRACT

A glass plate washing machine has transferring apparatus for transferring glass plates and a plurality of electric motors disposed above the transferring apparatus. The motors are disposed in rows across the transferring apparatus. The motors which belong to any one of the rows are staggered relative to the motors which belong to the next row. Each of the motors is provided with a buff grinder at the lower end of the output shaft thereof. The glass plate washing machine further has first positioning apparatus for positioning each of the motors in the vertical direction independently of the other motors and second positioning apparatus for positioning each of the motors around an axis parallel to the transferring direction of the transferring apparatus independently of the other motors.

27 Claims, 4 Drawing Sheets

GLASS PLATE WASHING MACHINE

BACKGROUND OF THE INVENTION

The present invention relates to a glass plate washing machine for washing curved glass plates.

Sputtering is one of the methods used for coating the surface of a glass plate with a thin metal film. If stains, traces of guard sheets, yellowed spots, etc., are present on the surface of the glass plate before sputtering, a thin metal film is sputtered on them. The thin metal film sputtered on the stains, guard sheet traces, yellowed spots, etc., is likely to tarnish or deteriorate. The stains, guard sheet traces, yellowed spots, etc., can be removed from the surface of the glass plate by spraying detergent on the surface and washing the surface with a buff grinder, with a buff made of felt, etc..

Various types of glass plate washing machines have been proposed for carrying out the above-mentioned washing process. For example, in Japanese Utility Model Laid-Open Publication Hei 2-1290, one of the inventors of the present invention proposed a glass plate washing machine which comprises buff grinders provided with buffs made of sponge. Japanese Utility Model Laid-Open Publication Sho 63-27249 discloses a glass plate washing machine for washing curved glass plates. The disclosed machine comprises a transferring apparatus for transferring a curved glass plate to a washing position where the curved glass plate is washed. The transferring apparatus has suction cups which adhere to the curved glass plate, first guide rails disposed above and across the washing position, which first guide rails are bent at substantially the same curvature as that of the curved glass plate, second guide rails disposed at right angles to the first guide rails and movably engaged with the first guide rails, which second guide rails are bent at substantially the same curvature as that of the curved glass plate, a movable body movably engaged with the second guide rails, and a polisher mounted on the movable body. In accordance with the glass plate washing machine of this construction, the curved glass plate is held by the suction cups of the transferring apparatus, whereby the curved glass plate is fixed on the transferring apparatus. Then, the curved glass plate is transferred to the washing position by the transferring apparatus, which can move horizontally and vertically. The polisher abuts against the curved glass plate. Detergent is sprayed on the surface of the curved glass plate. The polisher washes the surface of the curved glass plate, while the second guide rails move on the first guide rails and the movable body moves on the second guide rails. After the completion of the washing operation, the polisher separates from the curved glass plate and the curved glass plate is transferred back to the initial position by the transferring apparatus. Then the curved glass plate is detached from the suction cups of the transferring apparatus.

The glass plate washing machine disclosed in Japanese Utility Model Laid-Open Publication Hei 2-1290 is designed for washing flat glass plates and cannot handle curved glass plates. The glass plate washing machine disclosed in Japanese Utility Model Laid-Open Publication Sho 63-27229 is designed for washing curved glass plates and cannot operate efficiently because the process for transferring the curved glass plate to the washing position is complicated and the washing operation is carried out by batch processing. Moreover, if a curved glass plate of different curvature is to be washed, the guide rails have to be changed. In other words, the glass plate washing machine disclosed in Japanese Utility Model Laid-Open Publication Sho 63-27249 cannot promptly adapt itself to changes in the curvature of the curved glass plate.

SUMMARY OF THE INVENTION

An object of the present invention is to provide a glass plate washing machine for washing curved glass plates which can operate efficiently and can promptly adapt itself to changes in the curvature of the curved glass plate.

According to the present invention, there is provided a glass plate washing machine comprising transferring means for transferring glass plates and a plurality of electric motors disposed above the transferring means. The motors are disposed in rows across the transferring means. The motors which belong to any one of the rows are staggered relative to the motors which belong to the next row. Each of the motors is provided with a buff grinder at the lower end of an output shaft thereof. The glass plate washing machine further comprises first positioning means for positioning each of the motors in the vertical direction independently of the other motors and second positioning means for positioning each of the motors around an axis parallel to the transferring direction of the transferring means independently of the other motors.

According to a preferred embodiment of the present invention, the transferring means has a pair of endless belts disposed parallel to each other.

According to another preferred embodiment of the present invention, the transferring means has rollers each provided with a disk at either end thereof.

According to still another preferred embodiment of the present invention, adjacent buff grinders belonging to the same row rotate in opposite directions.

According to another preferred embodiment of the present invention, the first positioning means and the second positioning means are manually controlled.

According to another preferred embodiment of the present invention, the first positioning means and the second positioning means are numerically controlled.

According to another preferred embodiment of the present invention, the glass plate washing machine further comprises means for moving the glass plate washing machine.

Further objects, features and advantages of the present invention will become apparent from the Detailed Description of the Preferred Embodiments when read in conjunction with the accompanying drawings.

DETAILED DESCRIPTION OF THE PREFERRED EMBODIMENTS

Figure 1:
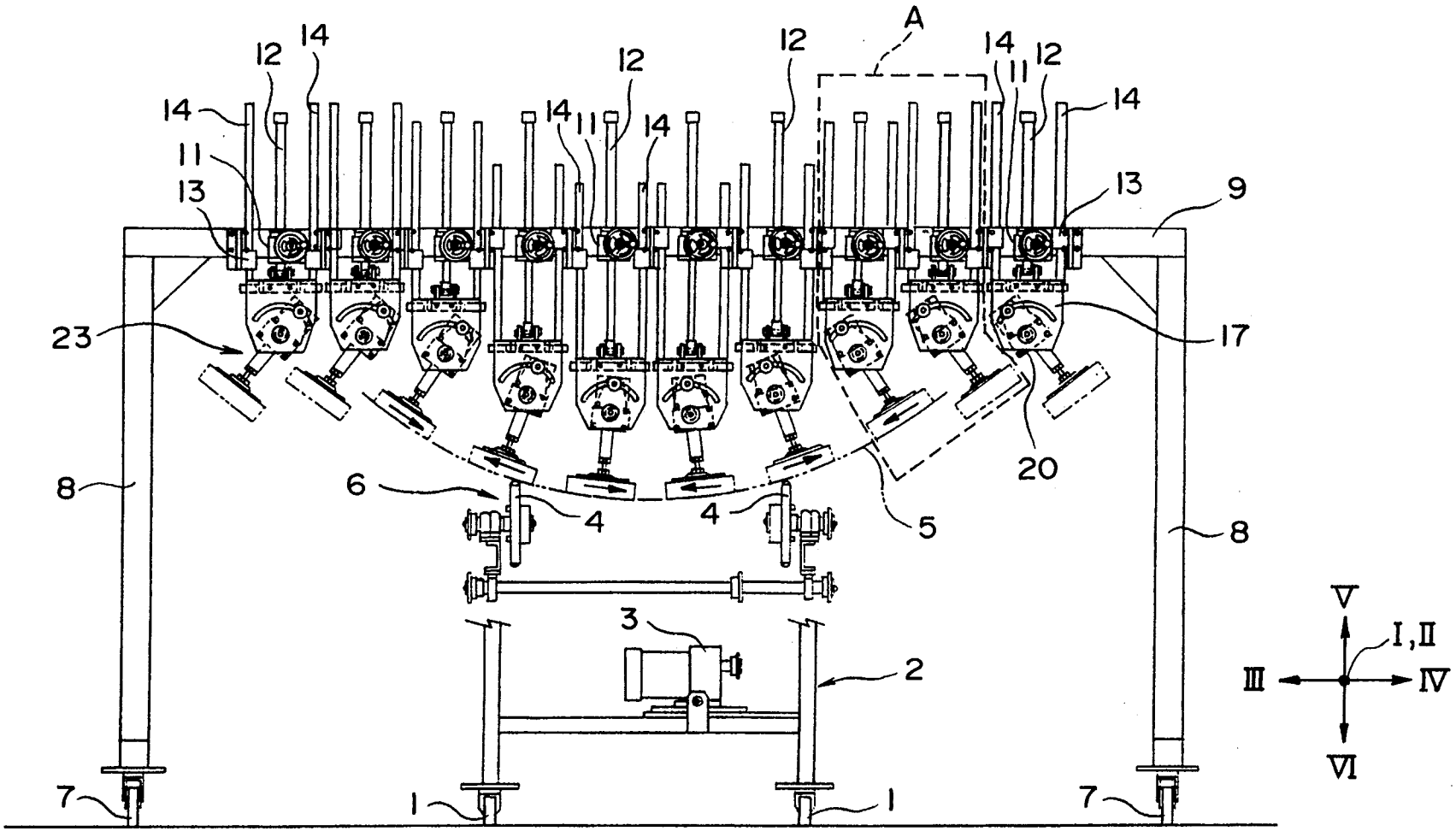
FIG. 1 is a front view showing a glass plate washing machine in accordance with a preferred embodiment of the present invention.
Figure 2:
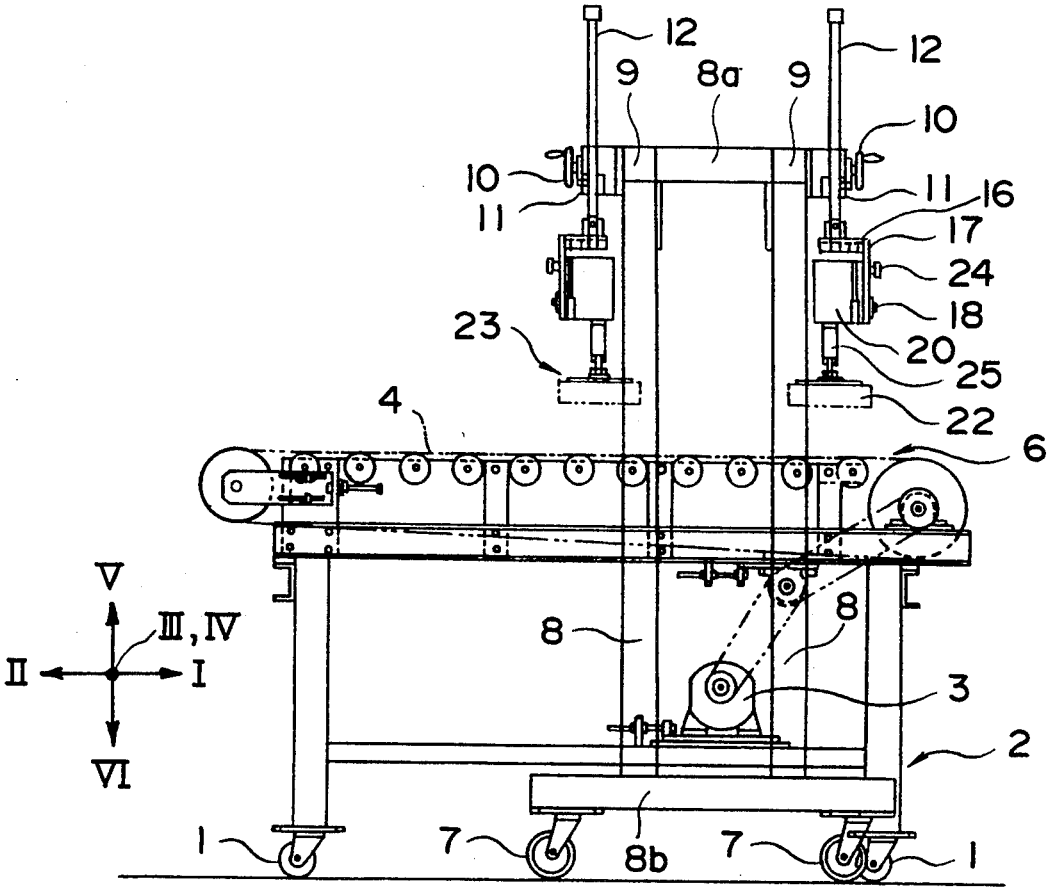
FIG. 2 is a left side view of the glass plate washing machine in FIG. 1.
Figure 3:
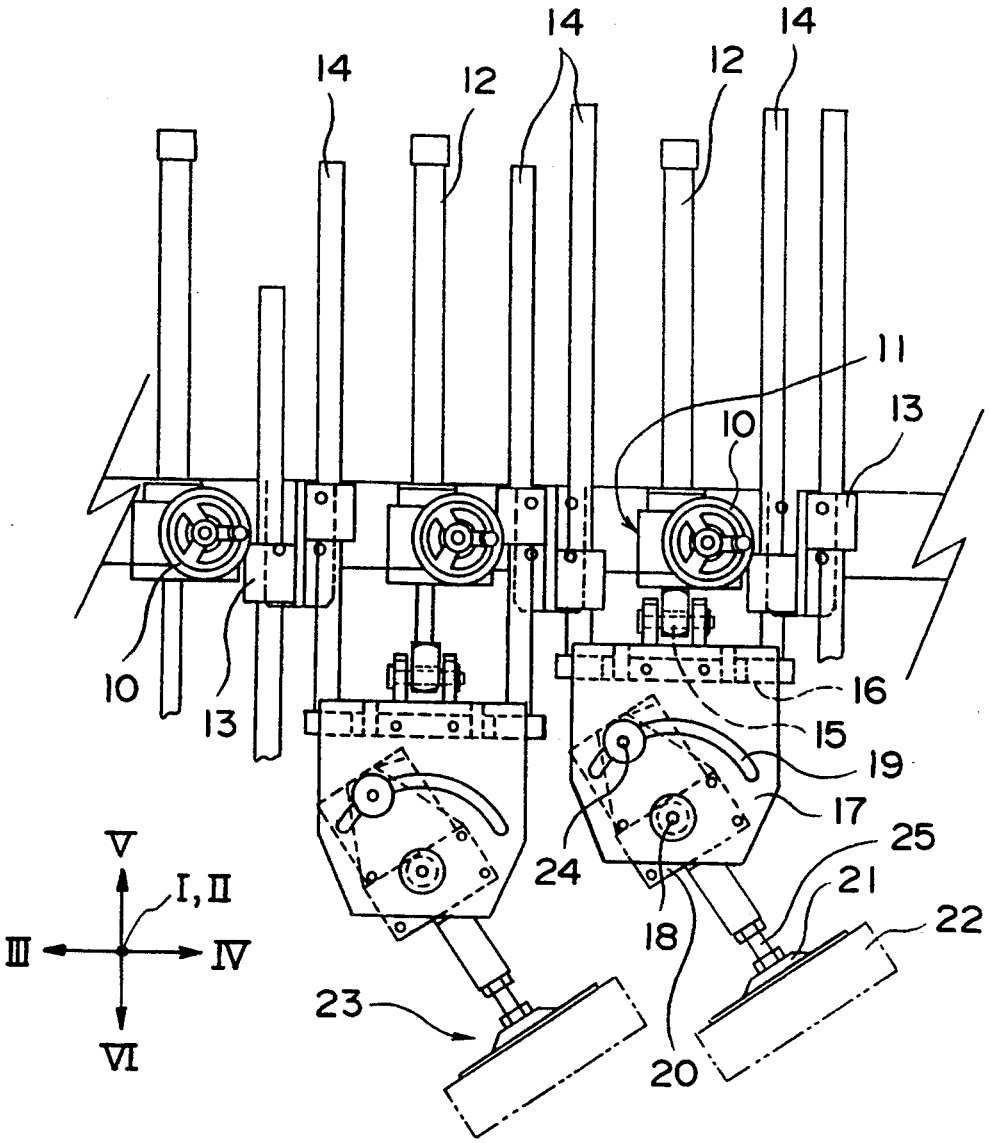
FIG. 3 is an enlarged view of part marked A in FIG. 1.

A glass plate washing machine in accordance with a preferred embodiment of the present invention will be described with reference to FIGS. 1 to 3. In the following description, the directions indicated by arrows I, II, III, IV, V and VI in FIGS. 1 to 3 are referred to as the forward direction, rearward direction, leftward direction, rightward direction, upward direction and downward direction, respectively. Moreover, in the following description, the direction parallel to the arrows I, II is referred to as the longitudinal direction, the direction parallel to the arrows III, IV is referred to as the transverse direction, and the direction parallel to the arrows V, VI is referred to as the vertical direction.

As shown in FIGS. 1 and 2, a plurality of casters 1 support a frame 2. An electric motor 3 is mounted on the frame 2. A pair of endless belts 4 for transferring a curved glass plate 5 extend in the longitudinal direction. The endless belts 4 are driven by the electric motor 3. A conveyor 6 comprising the pair of endless belts 4 is mounted on the frame 2. A pair of gate-shaped frames 8 are disposed adjacent to each other in the longitudinal direction. Transverse beams 9 of the frames 8 are disposed above and across the conveyor 6. The frames 8 are connected to each other by upper longitudinal beams 8*a* and lower longitudinal beams 8*b*. The frames 8 are supported by plurality of casters 7.

A plurality of screw jacks 11 are mounted on the transverse beams 9. Each of the screw jacks 11 has a handle 10 and a spindle 12 which is driven by the handle 10 in the vertical direction. A shaft support 16 is connected to the lower end of the spindle 12 at its transverse center by a transversely extending pin 15 to be rotatable around the pin 15. Guide shafts 14 are disposed on the left and right of the spindle 12. The shafts 14 extend in the vertical direction through casing units 13 mounted on the transverse beam 9 so as to be slidably supported by the casing units 13. The guide shafts 14 are connected to the shaft support 16 at their lower ends. A motor base 17 is fixed to the shaft support 16. A shaft 18 extends in the longitudinal direction through the motor base 17 and is rotatably supported by the motor base 17.

A motor 20 is fixed to the rear end of the shaft 18. The motor 20 is provided with a knob 22 slidably engaged with a circular arc shaped guide slit 19 formed on the motor base 17. An output shaft 25 of the motor 20 extends downward. The shaft 25 is provided with a pad 21 at its lower end. The pad 21 is detachably provided with a sponge buff 22 of a thickness of 25 to 75 mm. The pad 21 provided with the sponge buff 22 constitutes a buff grinder 23. The buff grinders 23 disposed on the front transverse beam 9 are staggered in the transverse direction relative to the buff grinders 23 disposed on the rear transverse beam 9. Thus, spaces between the buff grinders 23 disposed on the front transverse beam 9 are occupied by the buff grinders 23 disposed on the rear transverse beam 9 as viewed from the front.

The operation of the above described glass plate washing machine is as follows.

A curved glass plate 5 is placed on the endless belts 4 with its convex side facing downward. The handles 10 of the screw jacks 11 mounted on the transverse beams 9 are manually rotated so that the spindles 12 move downward together with the guide shafts 14 guided by the casing units 13. Thus the buff grinders 23 move down close to the upper surface of the curved glass plate 5. The motors 20 and the buff grinders 23 are manually rotated around the axes of the shafts 18 until the lower surfaces of the buff grinders 23 come to extend parallel to the upper surface of the glass plate 5. Then the knobs 22 are fastened so that the motors 20 and the buff grinders 23 are held at these rotational positions. The downward movements and the rotational movements of the buff grinders 23 are repeated until the sponge buffs 22 of the buff grinders 23 are uniformly pressed against the upper surface of the curved glass plate 5. Thus, the positioning of the buff grinders 23 is completed. After the completion of the positioning of the buff grinders 23, the curved glass plate 5 is pulled forward until it is released from the washing machine.

The motor 3 and the motors 20 are started. The curved glass plate 5 is again placed on the endless belts 2. The curved glass plate 5 moves rearward toward the buff grinders 23. A detergent, such as an alumina solution, etc., is sprayed on the curved glass plate 5 so that a water screen of the detergent is formed on the curved glass plate 5. The curved glass plate 5 reaches the buff grinders 23. The front edge of the curved glass plate 5 abuts against the lower side surfaces of the sponge buffs 22 of the rotating buff grinders 23. The sponge buffs 22 deform to allow the curved glass plate 5 to get under them.

The curved glass plate 5 moves rearward, while the sponge buffs 22 of the rotating buff grinders 23 are uniformly pressed against the upper surface of the curved glass plate 5. Thus, the upper surface of the curved glass plate 5 is washed by the rotating buff grinders 23 and the stains, guard sheet traces, yellowed spots, etc., are removed from the upper surface of the curved glass plate 5.

The areas between the buff grinders 23 disposed on the front transverse beam 9 and not washed when the curved glass plate 5 passes by the front transverse beam 9 are washed by the buff grinders 23 disposed on the rear transverse beam 9 since the buff grinders 23 on the rear transverse beam 9 are staggered in the transverse direction relative to the buff grinders 23 disposed on the front transverse beam 9. Thus, the entire upper surface of the curved glass plate 5 is washed.

As shown by the arrows in FIG. 1, adjacent buff grinders 23 rotate in opposite directions, so that uneven surface washing can be completely eliminated. The curved glass plate 5 which has passed through the washing machine then moves to the following rinsing and drying process.

The buff grinders 23 are provided with the sponge buffs 22 which operate as cushions so that excessive compressive forces are not applied on the curved glass plate 5 under the buff grinders 23. Moreover, rough adjustment of the vertical positions and the rotational positions of the buff grinders 23 can be tolerated because of the cushion effect of the sponge buffs 22. The rough adjustment of the vertical positions and the rotational positions of the buff grinders 23 does not adversely affect the transferring operation of the curved glass plate 5.

The curved glass plate 5 is placed on the pair of endless belts 4 so that it does not roll during the transferring operation. The curved glass plate 5 is transferred to the washing position by the endless belts 4 which move in only one direction, Thus the transferring process of the curved glass plate 5 is simple. A plurality of glass plates 5 can be washed continuously. The staggered arrangement of the buff grinders 23 makes it possible to wash the entire upper surface of the curved glass plate 5. Adjacent buff grinders 23 in the transverse direction rotate in opposite directions, so that uneven surface washing can be completely eliminated. As easily understood from the above description, the present glass plate washing machine can operate efficiently.

The buff grinders 23 can move in the vertical direction and can rotate around the longitudinal axes of the shafts ]8 so that, independently of the magnitude of the curvature of the curved glass plate 5 and independently of direction in which the convex side of the curved glass plate 5 faces, the buff grinders 23 can easily and promptly abut against the curved glass plate 5. If the curved glass plate 5 is small, the leftmost buff grinders 23 and the rightmost buff grinders 23 may be pulled up. As easily understood from the above description, the present glass plate washing machine can promptly adapt itself to changes in the curvature of the curved glass plate.

The present glass plate washing machine may be used for washing flat glass plates. As the present glass washing machine has casters 1, 7, it can be easily moved next to an existing glass washing machine for assisting it.

Figure 4:
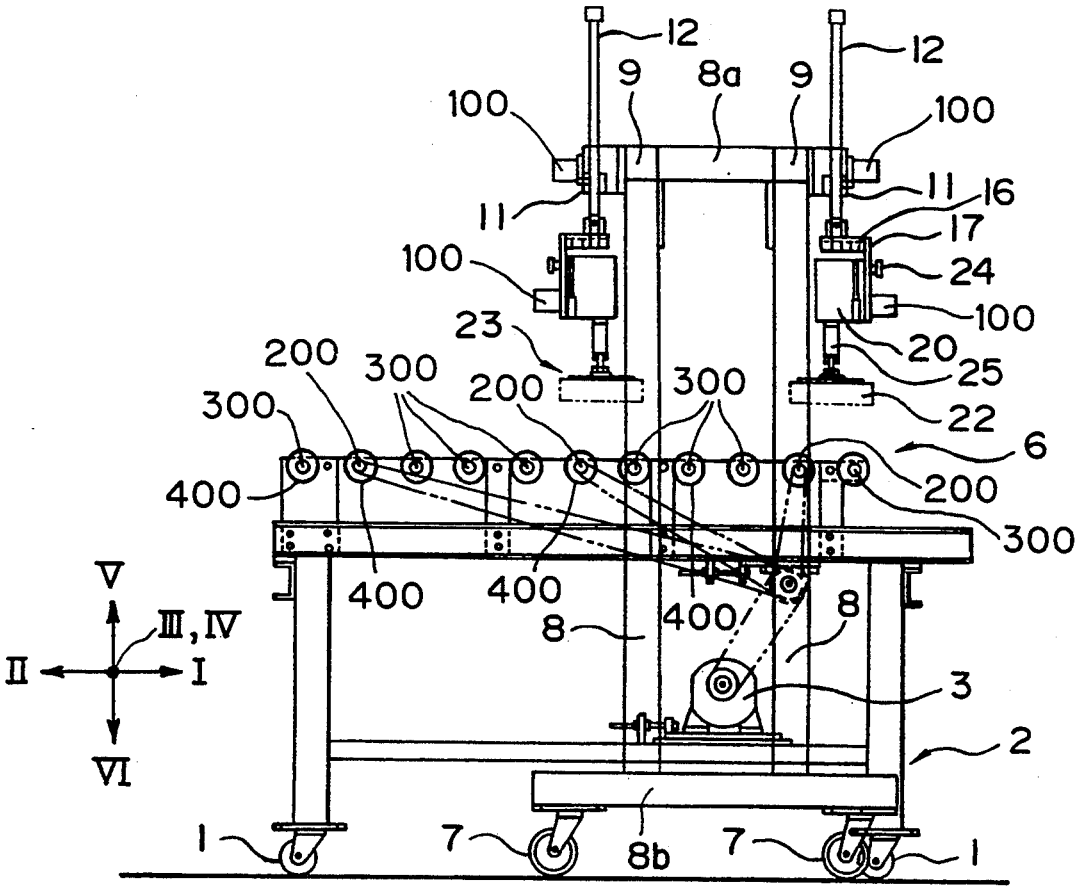
FIG. 4 is a left side view of a glass plate washing machine in accordance with another preferred embodiment of the present invention.

As shown in FIG. 4, stepping motors 100 may be used instead of handles 10 and for rotating the shafts 18. Then, the positioning of the buff grinders 23 relative to the curved glass plate 5 can be numerically controlled, which results in more prompt positioning of the buff grinders 23 relative to the curved glass plate 5.

As also shown in FIG. 4, the conveyor 6 may have driving rollers 200 and driven rollers 300 each of which has a disk at either end thereof, instead of the pair of endless belts 4 shown in FIG. 2.

While the present invention has been described with reference to the preferred embodiments, one of ordinary skill in the art will recognize that modifications and improvements may be made while remaining within the spirit and scope of the present invention. The scope of the invention is determined solely by the appended claims.

What is claimed is:

1. A glass plate washing machine comprising transferring means for transferring glass plates, a plurality of electric motors disposed above the transferring means, the motors being disposed in rows across the transferring means, the motors which belong to any one of the rows being staggered relative to the motors which belong to the next row, each of the motors being provided with a buff grinder at the lower end of an output shaft thereof, first positioning means for positioning each of the motors in the vertical direction independently of the other motors, and second positioning means for positioning each of the motors around an axis parallel to the transferring direction of the transferring means independently of the other motors.

2. A glass plate washing machine of claim 1, wherein said transferring means has a pair of endless belts disposed parallel to each other.

3. A glass plate washing machine comprising transferring means for transferring glass plates, the transferring means having rollers each of which is provided with a disk at either end thereof, a plurality of electric motors disposed above the transferring means, the motors being disposed in rows across the transferring means, the motors which belong to any one of the rows being staggered relative to the motors which belong to the next row, each of the motors being provided with a buff grinder at the lower end of an output shaft thereof, first positioning means for positioning each of the motors int he vertical direction independently of the other motors, and second positioning means for positioning each of the motors around an axis parallel to the transferring direction of the transferring means independently of the other motors.

4. A glass plate washing machine of claim 3, wherein adjacent buff grinders belonging to the same row rotate in opposite directions.

5. A glass plate washing machine of claim 3, wherein the first positioning means and the second positioning means are manually controlled.

6. A glass plate washing machine of claim 3, wherein the first positioning means and the second positioning means are numerically controlled.

7. A glass plate washing machine of claim 3, further comprising casters connected to and disposed for moving the washing machine.

8. A glass plate washing machine comprising transferring means for transferring glass plates, a plurality of electric motors disposed above the transferring means, the motors being disposed in rows across the transferring means, the motors which belong to any one of the rows being staggered relative to the motors which belong to the next row, each of the motors being provided with a buff grinder at the lower end of an output shaft thereof, adjacent buff grinders belonging to the same row rotating in opposite directions, first positioning means for positioning each of the motors in the vertical direction independently of the other motors, and second positioning means for positioning each of the motors around an axis parallel to the transferring direction of the transferring means independently of the other motors.

9. A glass plate washing machine of claim 8, wherein the first positioning means and the second positioning means are numerically controlled.

10. A glass plate washing machine of claim 8, further comprising casters connected to and disposed for moving the washing machine.

11. A glass plate washing machine comprising transferring means for transferring glass plates, a plurality of electric motors disposed above the transferring means, the motors being disposed in rows across the transferring means, the motors which belong to any one of the rows being staggered relative to the motors which belong to the next row, each of the motors being provided with a buff grinder at the lower end of an output shaft thereof, first manually-controlled positioning means for positioning each of the motors in the vertical direction independently of the other motors, and second manually-controlled positioning means for positioning each of the motors around an axis parallel to the transferring direction of the transferring means independently of the other motors.

12. A glass plate washing machine of claim 11, further comprising casters connected to and disposed for moving the washing machine.

13. A glass plate washing machine comprising transferring means for transferring glass plates, a plurality of electric motors disposed above the transferring means, the motors being disposed in rows across the transferring means, the motors which belong to any one of the rows being staggered relative to the motors which belong to the next row, each of the motors being provided with a buff grinder at the lower end of an output shaft thereof, first numerically-controlled positioning means for positioning each of the motors in the vertical direction independently of the other motors, and second numerically-controlled positioning means for positioning each of the motors around an axis parallel to the transferring direction of the transferring means independently of the other motors.

14. A glass plate washing machine of claim 13, further comprising casters connected to and disposed for moving the washing machine.

15. A glass plate washing machine comprising transferring means for transferring glass plates, a plurality of electric motors disposed above the transferring means, the motors being disposed in rows across the transferring means, the motors which belong to any one of the rows being staggered relative to the motors which belong to the next row, each of the motors being provided with a buff grinder at the lower end of an output shaft thereof, first positioning means for positioning each of the motors in the vertical direction independently of the other motors, second positioning means for positioning each of the motors around an axis parallel to the transferring direction of the transferring means independently of the other motors, and casters connected to and disposed for moving the washing machine.

16. A glass plate washing machine comprising:

transferring means for transferring glass plates in a longitudinal direction; and a first row of a plurality of polishers disposed above and across the transferring means, wherein each polisher has first positioning means for independently adjusting the polisher in a vertical direction and second positioning means for positioning the polisher around an axis parallel to the longitudinal direction.

17. A glass plate washing machine of claim 16, comprising a second row of a plurality of polishers disposed above and across the transferring means, wherein each polishers has first positioning means for independently adjusting the polisher in a vertical direction and second positioning means for positioning the polisher around an axis parallel to the longitudinal direction, and wherein the polishers of the second row are positioned to be staggered from the polishers of the first row.

18. A glass plate washing machine of claim 17, wherein each polisher comprises a motor, an axle operatively connected to the motor and a buffing pad for buffing glass plates connected to the axle and rotated when the motor is engaged.

19. A glass plate washing machine of claim 16, wherein said transferring means has a pair of endless belts disposed parallel to each other.

20. A glass plate washing machine comprising:

transferring means for transferring glass plates in a longitudinal direction;

a first row of a plurality of polishers disposed above and across the transferring means, wherein each polisher has first positioning means for independently adjusting the polisher in a vertical direction and second positioning means for positioning the polisher around an axis parallel to the longitudinal direction; and a second row of a plurality of polishers disposed above and across the transferring means, wherein each polisher has first positioning means for independently adjusting the polisher in a vertical direction and second positioning means for positioning the polisher around an axis parallel to the longitudinal direction;

the polishers of the second row being positioned to be staggered from the polishers of the first row;

each polisher having a motor, an axle operatively connected to the motor and a buffing pad for buffing glass plates connected to the axle and rotated when the motor is engaged; and adjacent buffing pads on the same row rotating in opposite directions.

21. A glass plate washing machine comprising:

transferring means for transferring glass plates in a longitudinal direction; and a first row of a plurality of polishers disposed above and across the transferring means, wherein each polisher has first manually-operated positioning means for independently adjusting the polisher in a vertical direction and second manually-operated positioning means for positioning the polisher around an axis parallel to the longitudinal direction.

22. A glass plate washing machine comprising:

transferring means for transferring glass plates in a longitudinal direction; and a first row of a plurality of polishers disposed above and across the transferring means, wherein each polisher has first numerically-operated positioning means for independently adjusting the polisher in a vertical direction and second numerically-operated positioning means for positioning the polisher around an axis parallel to the longitudinal direction.

23. A glass plate washing machine comprising:

transferring means for transferring glass plates, the transferring means having a pair of endless belts disposed parallel to each other, a plurality of electric motors disposed above the transferring means, the motors being disposed in rows across the transferring means, the motors which belong to any one of the rows being staggered relative to the motors which belong to the next row, each of the motors being provided with a buff grinder at the lower end of an output shaft thereof, adjacent buff grinders belonging to the same row rotating in opposite directions, firs positioning means for positioning each of the motors in the vertical direction independently of the other motors, and second positioning means for positioning each of the motors around an axis parallel to the transferring direction of the transferring means independently of the other motors.

24. A glass plate washing machine comprising:

transferring means for transferring glass plates, the transferring means having a pair of endless belts disposed parallel to each other, a plurality of electric motors disposed above the transferring means, the motors being disposed in rows across the transferring means, the motors which belong to any one of the rows being staggered relative to the motors which belong to the next row, each of the motors being provided with a buff grinder at the lower end of an output shaft thereof, first manually-controlled positioning means for positioning each of the motors in the vertical direction independently of the other motors and second manually-controlled positioning means for positioning each of the motors around an axis parallel to the transferring direction of the transferring means independently of the other motors.

25. A glass plate washing machine comprising:

transferring means for transferring glass plates, a plurality of electric motors disposed above the transferring means, the motors being disposed in rows across the transferring means, the motors which belong to any one of the rows being staggered relative to the motors which belong to the next row, each of the motors being provided with a buff grinder at the lower end of an output shaft thereof, adjacent buff grinders belonging to the same row rotating in opposite direction; first manually-controlled positioning means for positioning each of the motors in the vertical direction independently of the other motors, and second manually-controlled positioning means for positioning each of the motors around an axis parallel to the transferring direction of the transferring means independently of the other motors.

26. A glass plate washing machine comprising:

transferring means for transferring glass plates, the transferring means having a pair of endless belts disposed parallel to each other, a plurality of electric motors disposed above the transferring means, the motors being disposed in rows across the transferring means, the motors which belong to any one of the rows being staggered relative to the motors which belong to the next row, each of the motors being provided with a buff grinder at the lower end of an output shaft thereof, first numerically-controlled positioning means for positioning each of the motors in the vertical direction independently of the other motors and second numerically-controlled positioning means for positioning each of the motors around an axis parallel to the transferring direction of the transferring means independently of the other motors.

27. A glass plate washing machine comprising:

transferring means for transferring glass plates, the transferring means having a pair of endless belts disposed parallel to each other, a plurality of electric motors disposed above the transferring means, the motors being disposed in rows across the transferring means, the motors which belong to any one of the rows being staggered relative to the motors which belong to the next row, each of the motors being provided with a buff grinder at the lower end of an output shaft thereof, first positioning means for positioning each of the motors in the vertical direction independently of the other motors, second positioning means for positioning each of the motors around an axis parallel to the transferring direction of the transferring means independently of the other motors, and casters connected to and disposed for moving the washing machine.

* * * * *